US005562507A

United States Patent [19]

Kan

[11] Patent Number: 5,562,507

[45] Date of Patent: Oct. 8, 1996

[54] TWO-LAYER TYPE MULTI-WIRE CONNECTION SOCKET STRUCTURE

[76] Inventor: Bright Kan, No. 2-1, Sec. 2, Chung-fu Rd., Chung Li City, T'Ao Yuan Hsien, Taiwan

[21] Appl. No.: 344,364

[22] Filed: Nov. 25, 1994

[51] Int. Cl.[6] ..... H01R 23/02

[52] U.S. Cl. ..... 439/676; 439/79; 439/741

[58] Field of Search ..... 439/79, 676, 344, 439/701, 741, 638, 76.1, 510, 535

[56] References Cited

U.S. PATENT DOCUMENTS

| | | | |
|---|---|---|---|
| 4,734,043 | 3/1988 | Emert et al. | 439/676 |
| 4,767,338 | 8/1988 | Dennis et al. | 439/510 |
| 4,993,970 | 2/1991 | Littrell | 439/535 |
| 5,078,609 | 1/1992 | Bouchan et al. | 439/441 |

*Primary Examiner*—David L. Pirlot
*Assistant Examiner*—Brian J. Biggi
*Attorney, Agent, or Firm*—W. Wayne Liauh

[57] ABSTRACT

A two-layer multi-wire connecting socket structure is disclosed. It comprises a housing, a socket body, a plurality of pin seats arranged as an upper layer and a lower layer, and a pin package lid. The socket body has a plurality of through-holes arranged as an upper row and a lower row for receiving the upper layer and lower layer pin seats, respectively. The pin seat is formed as a generally L-shaped plastic member with a plurality of pins embedded therein. For each of the pins, one end thereof is bent to form a slanting terminal for contacting with a plug, and another end thereof is projecting outside of the plastic member for engaging with a PC board. The pin package lid covers one side of the socket body to allow the projecting pins to be securely spaced and aligned. The connecting socket structure so disclosed has the advantage of achieving smooth operation when a socket is inserted into a PC board. The two-layer structure also saves space on the PC board. Furthermore, the embedded pins in the pin seats cause the interfering noise signals from the outside to be substantially reduced.

1 Claim, 6 Drawing Sheets

TWO-LAYER TYPE MULTI-WIRE CONNECTION SOCKET STRUCTURE

BACKGROUND OF THE INVENTION

In the conventional wire connecting socket for printed circuit (PC) boards, the pin seats thereof are usually pressed and fastened to the socket body. The pins projecting outside of the socket body are difficult to align in straight rows. As a result, the operation of engaging the connecting socket with the PC board sometimes does not run smoothly. It is possible for some of the pins to bend or break when a connecting socket is inserted in a PC board too forcefully. Therefore, setting the pins in correct and straight arrangement is deemed an important factor in minimizing the defects of the products and to smoothen the manufacturing process.

SUMMARY OF THE INVENTION

This invention relates to a two-layer type multi-wire connecting socket structure which generally composes of a housing, a socket body, a plurality of upper and lower layer pin seats, and a pin package lid. The socket body has a plurality of through-holes formed in an upper row and a lower row for receiving the upper and lower layer pin seats respectively. The pin seat is generally formed in a L-shape plastic member with a plurality of pins embedded therein. One end of the pin is bent to form a slanting terminal for contact with a plug. Another end of the pin projects outside of the plastic member for engaging with a PC board. The pin package lid covers one side of the socket body to allow the projecting pins to be securely spaced and aligned. The connecting socket structure, according to the present invention, has the advantage of achieving smooth operation in inserting a socket in a PC board. The two-layer structure also saves space on the PC board. The embedded pins in the pin seats can reduce noise signal interference from outside.

DETAILED DESCRIPTION

Figure 1:
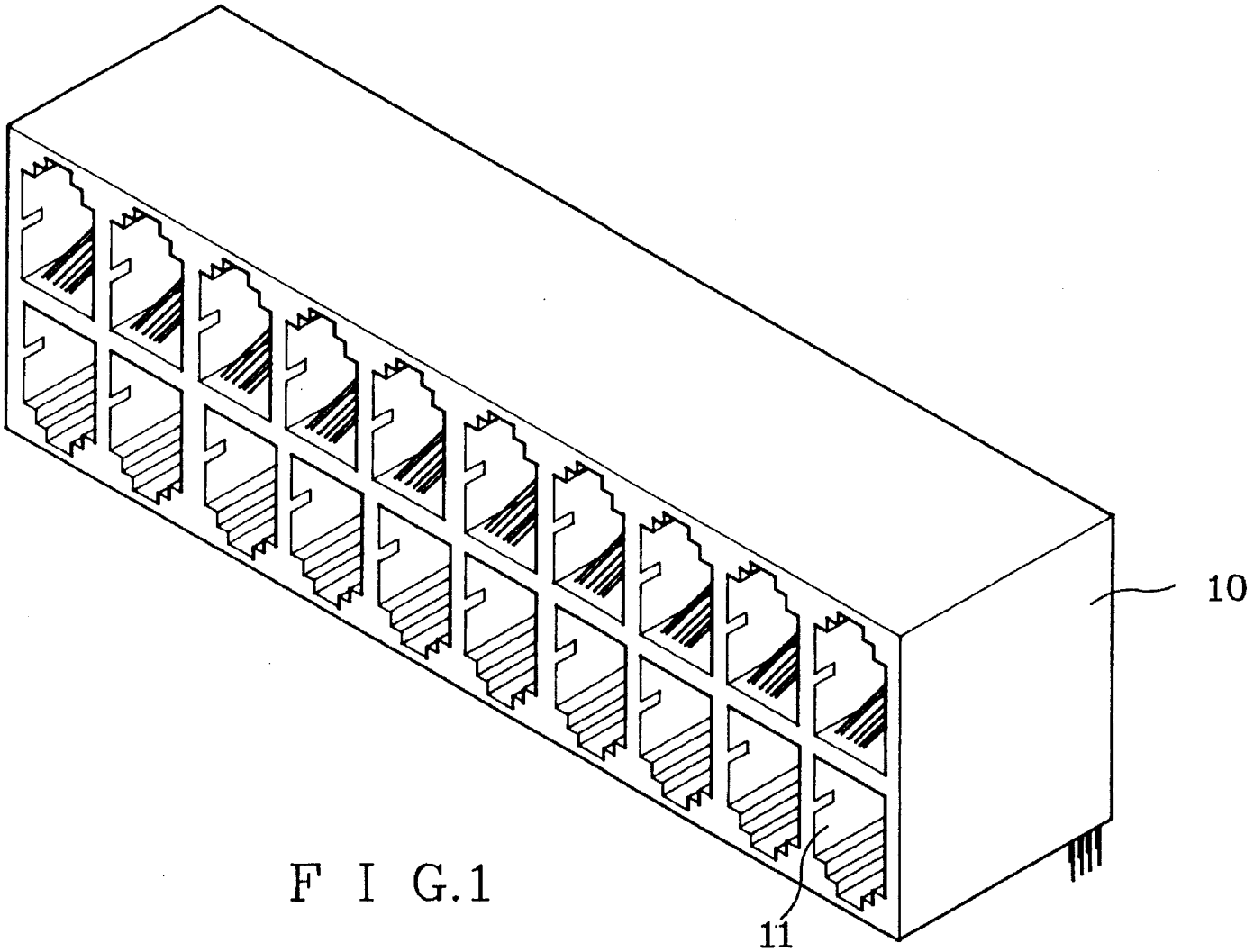
FIG. 1 is a perspective view of an embodiment according to the present invention.
Figure 2:
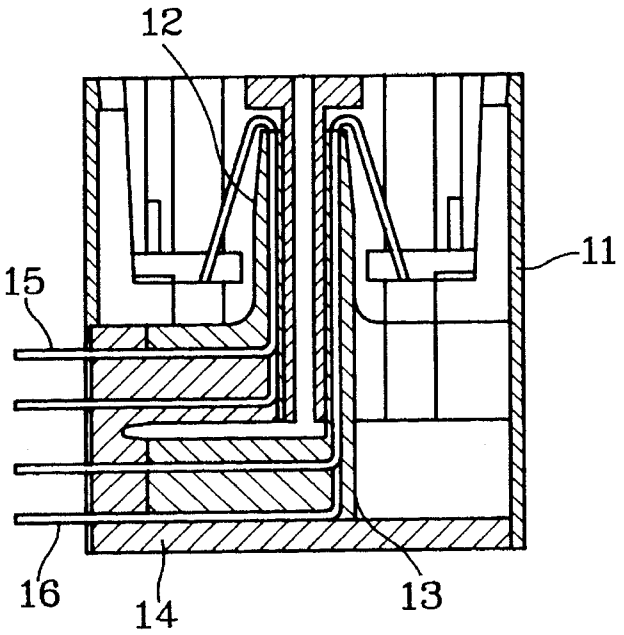
FIG. 2 is a sectional view of the embodiment according to the present invention, showing the inner structure thereof.
Figure 3:
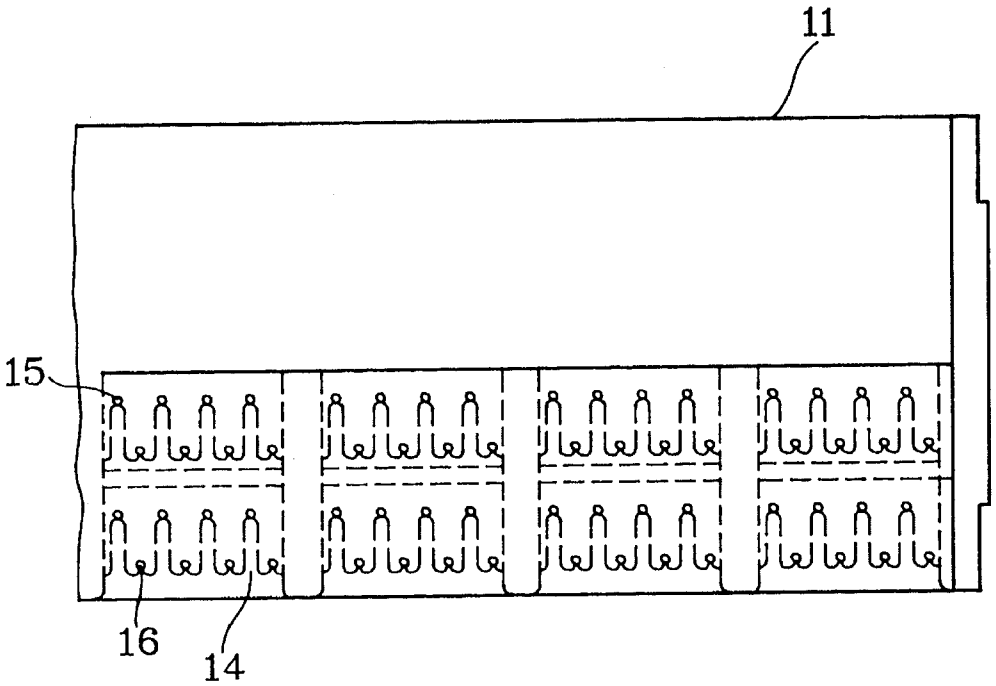
FIG. 3 is a bottom view of the present invention.
Figure 4:
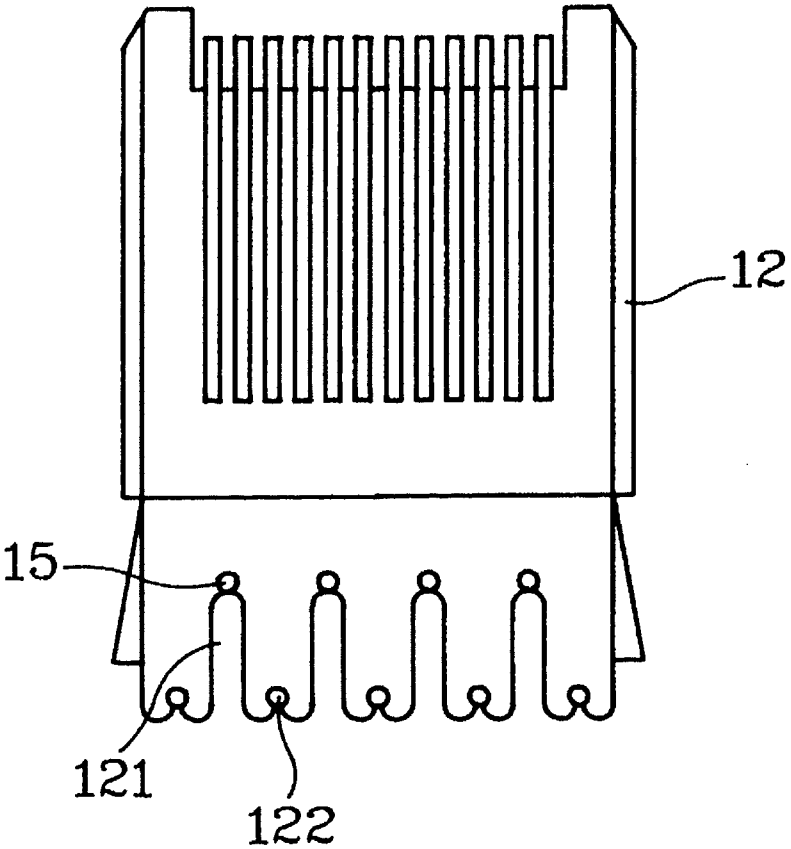
FIG. 4 is a bottom view of the lower layer pin seat of the present invention.
Figure 5:
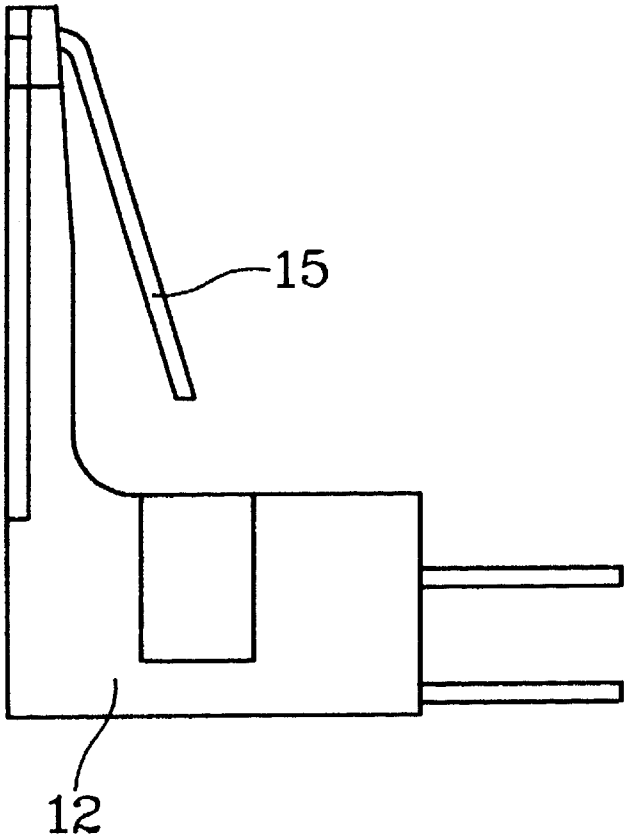
FIG. 5 is a side view of the lower layer pin seat of the present invention.
Figure 6:
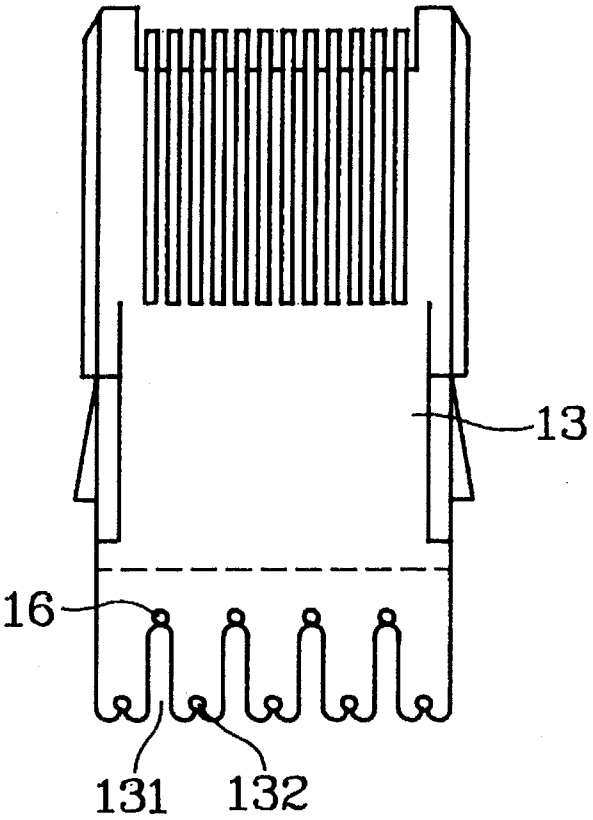
FIG. 6 is a top view of the upper layer pin seat of the present invention.
Figure 7:
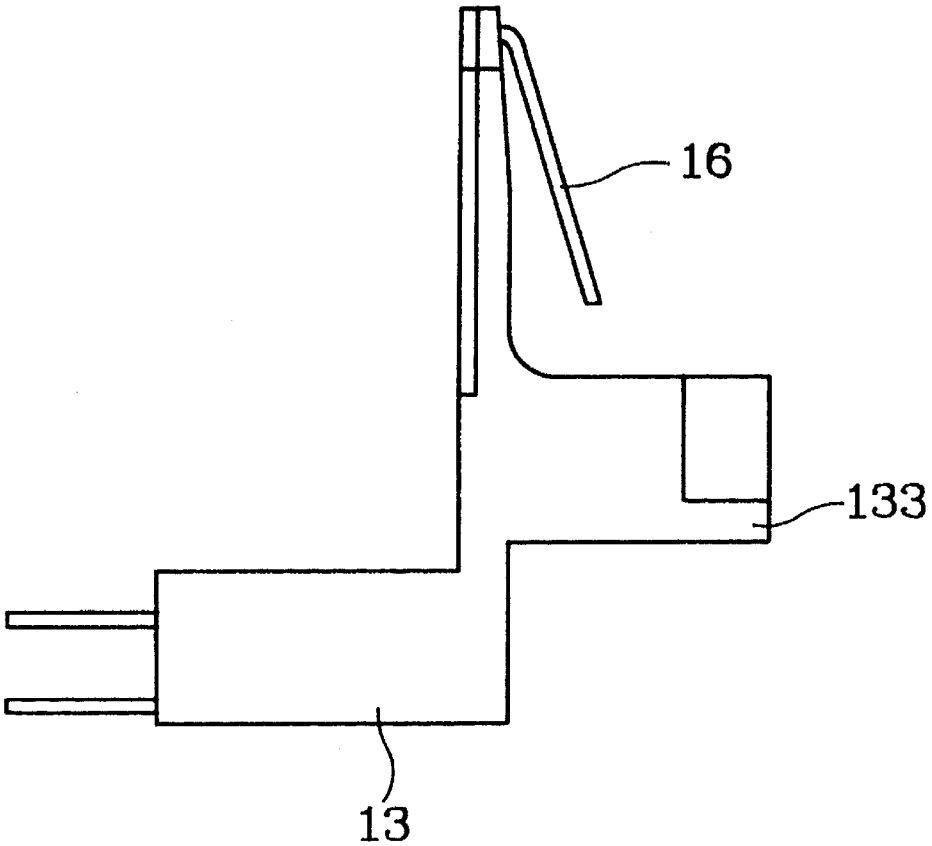
FIG. 7 is a side view of the upper layer pin seat of the present invention.
Figure 10:
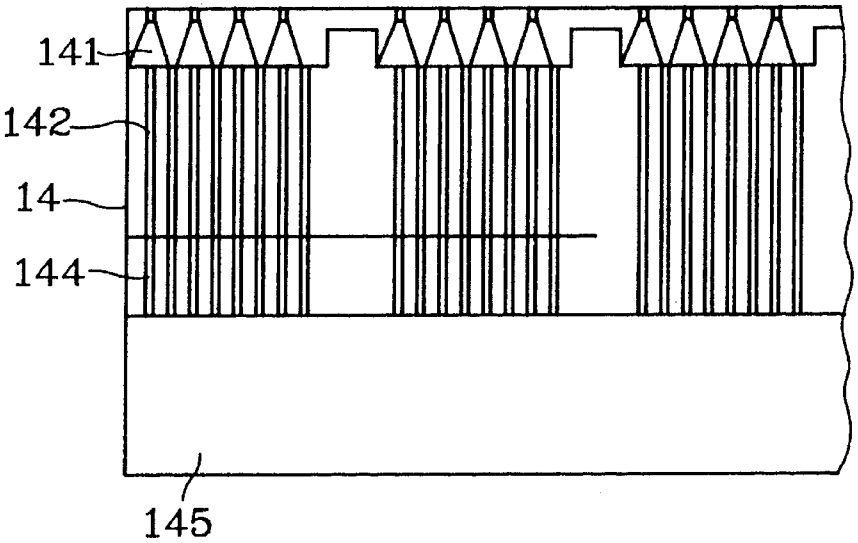
FIG. 10 is a front view of the pin package lid of the present invention.
Figure 8:
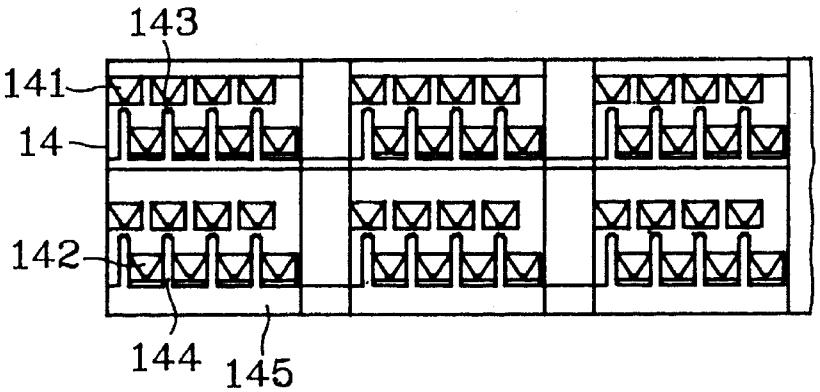
FIG. 8 is a top view of a pin package lid of the present invention.
Figure 9:
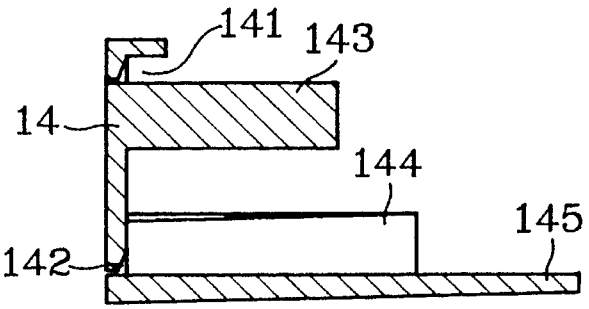
FIG. 9 is a side view of the pin package lid of the present invention.
Figure 12:
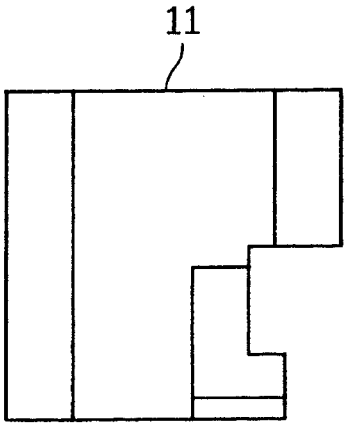
FIG. 12 is a side view of the socket body according to the present invention.
Figure 11:
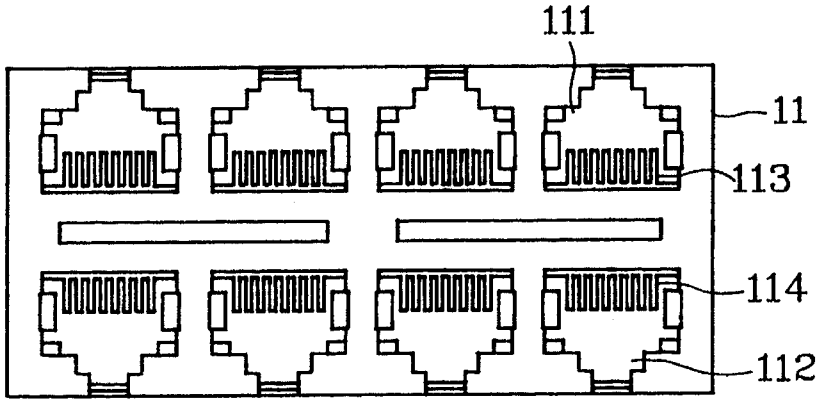
FIG. 11 is a front view of the socket body according to the present invention.
Figure 13:
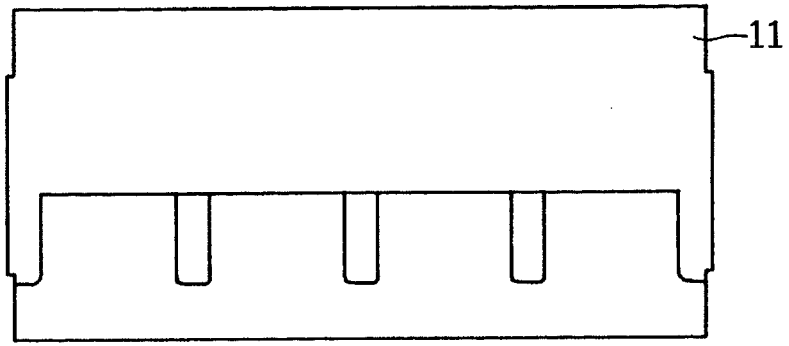
FIG. 13 is a bottom view of the socket body according to the present invention.

This invention relates to a two-layer type multi-wire connecting socket structure as shown in FIG. 1. It includes a housing 10, a socket body 11, a plurality of lower layer pin seats 12, a plurality of upper layer pin seats 13, and a pin package lid 14 (as shown in FIG. 2). The socket body 11, made of a plastic material, includes two rows of through-holes (i.e., the upper row through-holes 111 and the lower row through holes 112 as shown in FIG. 11). The wide-bottom part of each such through-hole is furnished with a plurality of upper and lower pin isolation plates 113 and 114. Through-holes 11 and 112 are to receive the lower layer and upper layer pin seats 12 and 13 respectively. The lower layer pin seat 12 as shown in FIGS. 4 and 5 is a L-shape member made of a plastic material through an injection molding. One side of the lower layer pin seat 12 is furnished with a plurality of shallow grooves 122 and deep grooves 121. The pin seat 12 is also provided with a plurality of pins 15 embedded therein. One end of each pin 15 is bent into a slanting terminal to allow close contact with a plug, while the other end of the pin 15 is bent at an angle of 90 degrees and fastened into shallow and deep grooves 121 and 122 alternatively and is projected out of the pin seat 12 for plugging in a PC board. The upper layer pin seat 13 as shown in FIGS. 6 and 7 is a plastic member which has a plurality of pins 16 embedded inside. One end of the pin 16 is bent to form a slanting terminal while another end is bent at a 90-degree angle in the opposite direction of the slanting terminal. One side of the upper layer pin seat 13 is furnished with a plurality of shallow grooves 132 and deep grooves 131. The upper layer pin seat 13 is also provided with two stop lugs 133 for limiting the inserting distance of a plug. After the pin seats 12 and 13 are inserted into the socket body 11, a pin package lid 14 as shown in FIGS. 8 to 10 is disposed and covers the openings of the through-holes located on another side of the socket body 11 as shown in FIG. 2. Pin package lid 14 is furnished with a plurality of pin-guiding parts 141 and 142 to allow the insertion of pins 15 and 16. Pin package lid 14 is also provided with a plurality of deep-groove pressing leaf springs 143 and 144 for plugging into deep grooves 121 and 131. Pin package lid 14 further provides a sealing plate 145 to prevent pins 15 and 16 from exposing to the outside as shown in FIGS. 2 and 3. In order to provide additional shielding effect, the socket body 11 is covered with a metal housing 10.

In summary, the present invention provides two layers of connecting socket which can greatly save space on a PC board. The pin seat with embedded pins can reduce noise signal interference coming from outside. The pin package lid enables the pins to be securely spaced and aligned to smoothen the inserting operation of the socket in a PC board, and can also greatly reduce the defect rate.

I claim:

1. A two-layer multi-wire connecting structure comprising:

a housing;

a socket body made of plastic material through injection molding, said socket body including a plurality of through-holes arranged as an upper layer and a lower layer, each of said through-holes having a wide-bottom side upon which a plurality of pin isolation plates are formed;

an upper layer pin seat made of plastic material molded in a substantially L-shaped form with a first bottom member, a first vertical member, and two spaced-apart stop lugs extending horizontally in the direction opposite the first bottom member, the first bottom member having a plurality of first shallow grooves and first deep grooves alternately formed therein, each of said first shallow grooves and first deep grooves having a first pin disposed therein, the first pin having one end extended out of the first bottom member in the direction opposite the stop lugs and another end extended out of the first vertical member and being bent to form a first slanting terminal in the direction of the stop lugs;

a lower layer pin seat made of plastic material molded in a substantially L-shaped form with a second bottom member and a second vertical member, the second bottom member having a plurality of second shallow grooves and second deep grooves alternately formed therein, each of said second shallow grooves and second deep grooves having a second pin disposed therein, the second pin having one end extended out of the second bottom member and having another end extended out of the second vertical member and being bent to form a second slanting terminal in the direction of the second button member; and a pin package lid having a plurality of cone-shaped pin-guiding channels formed therein for insertion of the first pins and the second pins, and having a plurality of pressing leaf springs disposed therein for engaging with the first deep grooves and the second deep grooves; wherein the upper layer pin seat is disposed in one of said through-holes in the upper layer, the lower layer pin seat is disposed in one of said through-holes in the lower layer, and the pin package lid is located on one side of the socket body and covers the opening of said through-holes, and having a plurality of cone-shaped channels to allow the first pins and the second pins to pass therethrough.

* * * * *